US005572802A

United States Patent [19]

Alpenfels et al.

[11] Patent Number: 5,572,802

[45] **Date of Patent: *Nov. 12, 1996**

[54] APPARATUS FOR DRYING ELECTROPHORESIS GELS

[75] Inventors: William F. Alpenfels, Del Mar; Sheldon Engelhorn, Encinitas; David J. Manis, Del Mar, all of Calif.

[73] Assignee: Novel Experimental Technology, San Diego, Calif.

[ * ] Notice: The term of this patent shall not extend beyond the expiration date of Pat. No. 5,440,822.

[21] Appl. No.: 511,183

[22] Filed: Aug. 4, 1995

Related U.S. Application Data

[63] Continuation of Ser. No. 93,105, Jul. 16, 1993, Pat. No. 5,440,822.

[51] Int. Cl.[6] ..... F26B 11/18; F26B 11/22

[52] U.S. Cl. ..... 34/192; 34/237; 34/238

[58] Field of Search ..... 34/237–39, 192, 34/303, 305, 92; 204/299 R, 182.8

[56] References Cited

U.S. PATENT DOCUMENTS

| | | | |
|---|---|---|---|
| 3,935,646 | 2/1976 | Grandine et al. | 34/92 |
| 4,020,563 | 5/1977 | Hoefer | 34/48 |
| 4,612,710 | 9/1986 | Fernwood et al. | 34/16 |
| 4,788,778 | 12/1988 | Fernwood | 34/92 |
| 4,883,597 | 11/1989 | Perlman | 210/640 |
| 4,896,434 | 1/1990 | Fanelli | 34/1 |
| 5,040,312 | 8/1991 | Hölzel | 34/92 |
| 5,234,559 | 8/1993 | Collier et al. | 204/182.8 |

OTHER PUBLICATIONS

U.S. Department of Energy, Assistant Secretary, Conservation and Renewable Energy, *Proceedings of the DOE Heat Pump Contractors' Program Integration Meeting*, Mar., 1982, pp. 59–61.

Advertisement for "Gel Drying Frames", Owl Scientific Inc. (circa Jan. 1992).

Advertisement for "Gel Drying Frame", Kem–En–Tec (received Oct. 1992).

Advertisement for "Gel Dryers", Hoefer Scientific Instruments (circa Jan. 1992).

Advertisement for "Biolab Gel Dryers", Ann Arbor Plastics/Scientific Products Department, Biotechniques (Feb. 1992).

Advertisement for "NOVEX Gel Dryer", Novel Experimental Technology (Jan. 1992).

Wallevik et al., "A simple and reliable method for drying of polyacrylamide slab gels", Journal of Biochemical and Biophysical Methods, 6 (1982) 17–21.

Lim et al., "Autoradiography with Acrylamide Gel Slab Electrophoresis", Analytical Biochemistry, 29, 48–57 (1969).

*Primary Examiner*—John M. Sollecito
*Assistant Examiner*—Steve Gravini
*Attorney, Agent, or Firm*—Fish & Neave

[57] ABSTRACT

A method and apparatus for drying electrophoresis gels. The apparatus includes a base unit and gel drying frame assembly. The base unit serves as a both a support for the frame when placing the gel in the frame and as a receptacle for excess liquid used to prepare the gel for the drying process. The frame is used to securely hold the gel in place while preparing the gel for drying and also during the drying process itself.

7 Claims, 4 Drawing Sheets

APPARATUS FOR DRYING ELECTROPHORESIS GELS

This is a continuation of application Ser. No. 08/093,105, filed Jul. 16, 1993 entitled METHOD AND APPARATUS FOR DRYING ELECTROPHORESIS GELS, now U.S. Pat. No. 5,440,822.

BACKGROUND OF THE INVENTION

This invention relates to an apparatus and method for drying electrophoresis gels following the process of electrophoresis separation.

Gel electrophoresis is a common procedure for the separation of biological molecules, such as DNA, RNA, polypeptides and proteins, in which the molecules are separated into bands according to their migration through a filtering gel in response to an imposed electric field. The extent of migration is a function of a number of factors, including the charge density of the migrating molecules and their molecular weight, size and shape.

The basic apparatus used in this technique consists of the gel, usually formed from polyacrylamide, agarose or starch, enclosed in a glass tube or sandwiched as a slab between glass or plastic plates. Electrophoresis gels generally have an open molecular network structure, with spaces large enough to admit passage of the migrating molecules, placed in a buffered solution of a salt that conducts an electric in water solution. These gels are typically 70% to 95% water, After the various migrating molecules have been separated within a slab gel, it is common to dry the gel prior to conducting analysis of the bands of the migrating molecules within the gel.

While drying, electrophoresis gels tend to shrink in any dimension that is not supported by filter paper, film or other support media. Substantial shrinkage of the gel tends to make analysis of the migration bands difficult, if not impossible. Uneven gel surfaces resulting from uncontrolled shrinkage also tend to make storage of the dried gel difficult. In order to be useful, the dried gel should be flat and substantially maintain its length and width. These characteristics are best maintained by supporting the surfaces of the gel with filter paper, film, or other support media while drying.

Three attributes generally are required of a gel drying system to get flat, intact dried slab gels. First, the gel must adhere to a porous supporting material such as a cellophane membrane or filter paper throughout the drying process. This support maintains the length and width of the gel during drying. Should part of the gel detach from the support during drying, the gel may crack; air bubbles between the gel and the support tend to prevent attachment. Second, the supporting materials, in turn, must be secured against a surface or around the perimeter so that the support remains flat and dimensionally stable. Should the support slip or move during the drying process, the gel may crack or distort. Finally, all portions of the gel should dry uniformly. If one area dries faster than an adjacent area, uneven stress develops, often leading to cracking. These three attributes are required in an effective drying system to prevent gel cracking.

A variety of methods and apparatus have been used to facilitate the drying of electrophoresis gels. One such method, disclosed in U.S. Pat. No. 4,883,597, consists of extracting water vapor from a gel supported by a hydrophobic polyethylene membrane by applying a vacuum through the membrane. The vacuum also holds the gel firmly against the membrane.

Other more complex gel drying devices utilize both heat and vacuum sources to vaporize moisture from the gels. The combination of the heat and vacuum is often used in an attempt to uniformly remove moisture from the gels so as to avoid distortion or cracking of the gel during the drying process. Such a drying procedure commonly entails positioning the gel matrix on a filter paper and placing the resulting combination of filter paper and gel matrix within a drying apparatus in which the combination is subject to a vacuum source and heated to remove liquid from the gel. One example of such a device is disclosed in U.S. Pat. No. 4,020,563.

Similarly, U.S. Pat. Nos. 4,612,710 and 4,788,778 disclose a method and apparatus in which heat is supplied to a horizontal gel slab from a heating plate above the slab while drawing a vacuum beneath.

The drying of electrophoresis slab gels without vacuum is known. A relatively simple, inexpensive device for drying at ambient pressure is the Mini-Gel Dryer™ drying system manufactured by Novex (Novel Experimental Technology) of San Diego, Calif. That device, however, allows for vaporization to occur on only one side of the gel. The stresses caused by drying on only one side of the may lead to cracking.

A vacuum-less drying method which allows evaporation from both sides of a slab gel is described in K. Wallevik and J. C. Jensenius, *J. of Biochemical* and *Biophysical Methods,* 6 (1982) 17–21. The method is accomplished using a device having two identical frames held together by metal binder clamps. Between the frames is a sandwich of a slab gel between two sheets of uncoated cellophane. When properly assembled, this device securely holds the cellophane supporting sheets, and the gel adheres to the cellophane. In order to obtain good results with this technique, the gels must be flooded with liquid; however, no provision is made for containing the potentially hazardous, excess liquid. Applicants overcome this disadvantage through the addition of a trough to the drying system of applicants' invention for the accumulation of excess liquids.

Hoeffer Scientific Instruments manufactures a gel drying system consisting of a platform that fits inside half of the frame, this frame-platform combination makes a level surface; simplifying assembly of the gel-cellophane sandwich. Kem-En-Tec manufactures a different system, in which legs built into the frame suspend the frame assembly horizontally above the bench top. Unlike applicants' invention, the systems manufactured by Hoeffer and Kem-En-Tec make no provision for containing potentially hazardous, excess liquids.

In addition, the drying systems manufactured by Hoeffer and Kem-En-Tec use two different frame sections. The frame sections interlock to avoid any horizontal sliding during assembly. Because the frame sections are not identical, two different mold cavities must be fabricated. Applicants' invention overcomes this disadvantage by utilizing identical frame sections that require only a single mold cavity.

Furthermore, all of these prior art techniques hold the frame assembly horizontally to dry the gel, which often results in evaporation from the top surface being faster than from the bottom surface. Such uneven evaporation may lead to cracking or other distortion of the gel. This problem may be overcome by directing an air stream over the top and bottom surface of the dryer.

In view of the disadvantages of the prior art methods and apparatus that have been used to dry electrophoresis gels, an apparatus is needed for drying electrophoresis slab gels in ambient air without distortion or fracture and utilizing a method which is easy to perform without complex steps or complicated equipment.

SUMMARY OF THE INVENTION

Figure 1:
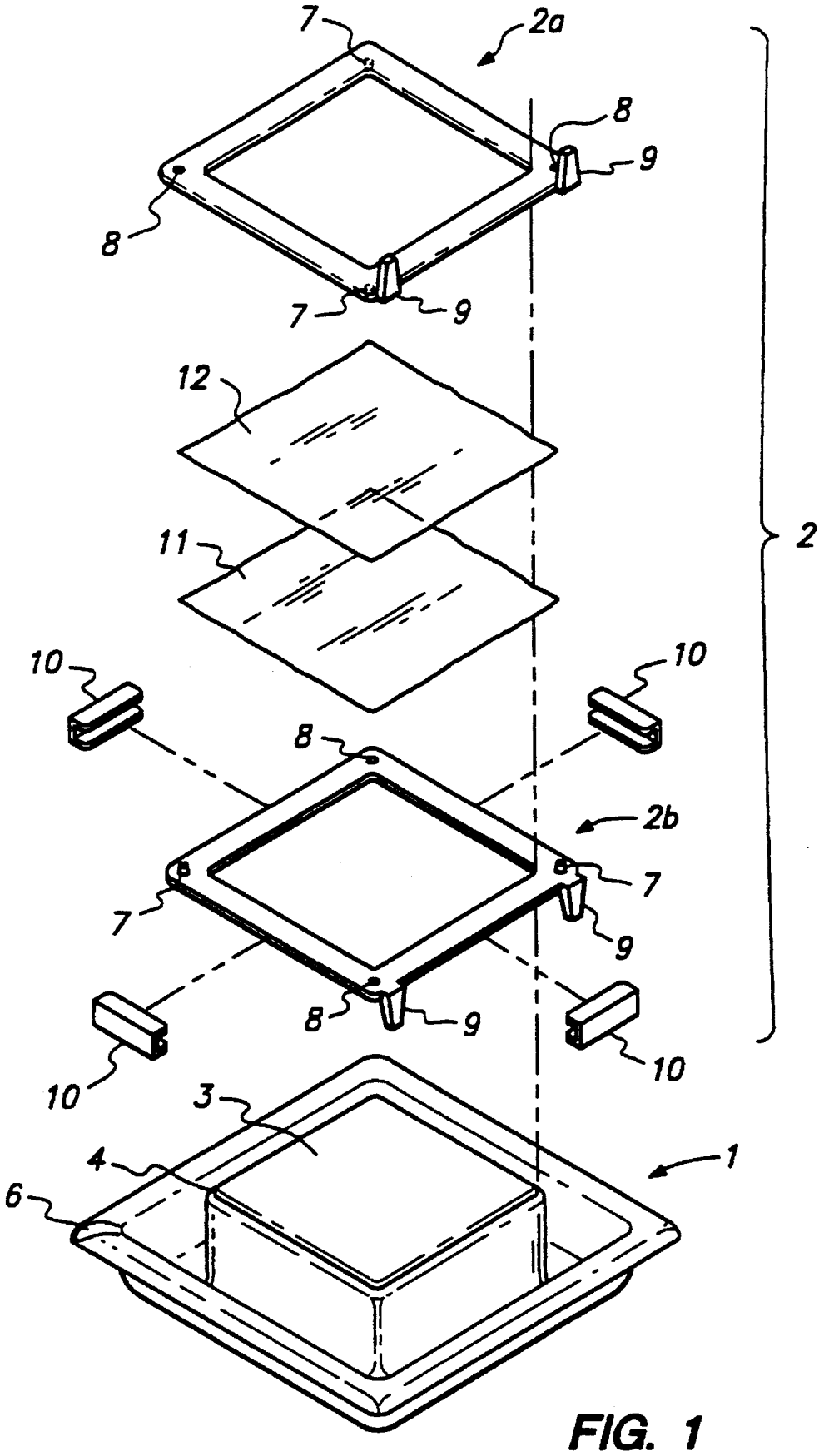
FIG. 1 is an exploded perspective view of a frame assembly and base unit which illustrates an exemplary embodiment of the present invention.

It is an object of this invention to provide an electrophoresis drying apparatus which can be used to dry an electrophoresis gel in ambient air.

It is an object of this invention to provide an electrophoresis drying apparatus which can be used without the need for air stream, heat or vacuum sources.

It is also an object of this invention to provide an electrophoresis drying apparatus which allows vaporization to occur from both sides of the gel.

It is also an object of this invention to provide an electrophoresis drying apparatus which can dry electrophoresis gels without cracking or distorting the gel.

It is a further object of this invention to provide an electrophoresis gel drying apparatus which has a trough for the accumulation of excess liquid generated during the pre-treatment phase of the gel drying process.

It is yet after object of this invention to provide an electrophoresis gel drying apparatus which eliminates the need for racks or other drying equipment.

It is another object of this invention to provide a relatively inexpensive drying apparatus which is easy to use.

It is yet another object of this invention to provide a frame assembly for the drying of electrophoresis gels that is made of two identical interlocking frame sections.

In accordance with the invention, in both the apparatus and method a base unit and frame assembly are used in conjunction with one another to prepare the gel for the drying procedure and to facilitate the drying process itself. The base unit serves as a support for the frame during preparation of the gel and receptacle for the pre-treatment solution used to prepare the gel for the drying process. The frame assembly includes two identical frame sections which, when combined together, securely hold an electrophoresis gel horizontally in place between two pieces of film. One frame section of the frame assembly is used in conjunction with the base unit to facilitate rinsing of the gel with desired solutions and to facilitate the proper placement of the gel in the completed frame assembly during the drying phase of the process. Each frame section contains a plurality of alignment pins and alignment holes that serve to securely and precisely prevent the frame sections from slipping when assembled. Each frame section also contains two supports along one edge that allow the frame assembly to be placed upright on a horizontal surface for the two-sided drying of the gel in ambient air.

The result is a simple, compact, and inexpensive yet elegant gel drying system that avoids the complexity and expense of drying systems of the prior art. The invention simply and effectively avoids the problems of gel cracking during drying with minimal expense and technical complexity.

The method and apparatus of the present invention are particularly suitable for the drying of polyacrylamide gels of up to 1.5 mm thick and having up to 27% acrylamide concentration. The method and apparatus of the present invention are suitable for drying polyacrylamide gels of greater thickness but the acrylamide concentration generally must be reduced. The method and apparatus of the present invention produces gels that are dried to a thin, flexible transparent film suitable for photography, densitometry, autoradiography, fluorography or permanent storage.

DETAILED DESCRIPTION OF THE INVENTION

An electrophoresis drying system representing an exemplary embodiment of the present invention is shown in FIG. 1 in exploded form. The system includes a base unit 1 and a frame assembly 2. Frame assembly 2 includes frame sections 2*a* and 2*b*, two cellophane. sheets 11 and 12, and four clips 10. Both base unit 1 and frame assembly 2 are generally square in shape although they may also take a substantially rectangular form.

Figure 2A:
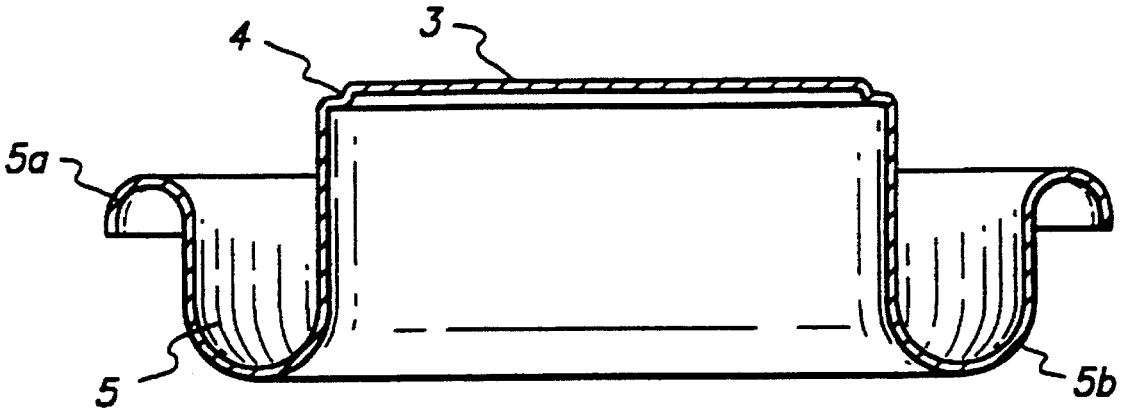
FIG. 2*a* is a cross-sectional view of the base unit.

As shown in FIG. 2*a*, base unit 1 has an elevated surface 3 for supporting frame assembly 2 (shown in FIG. 1). The surface must generally be free of any deep visible scratches, blemishes or molding defects. The outer edge of the elevated surface contains a stabilizing indentation 4 for holding frame assembly 2 in place during the gel preparation procedure and during the assembly of frame sections 2*a* and 2*b*. The indentation should be of a depth sufficient to accommodate the thickness of frame section 2*b* such that when frame section 2*b* is placed in indentation 4 the upper surface of frame section 2*b* is coplanar with elevated surface 3 of base unit 1.

As further shown in FIG. 2*a*, base unit 1 also contains an open trough S for collecting excess liquid generated during the preparation of the gel for drying. In the embodiment shown in FIGS. 1–4, the trough of the base unit is generally rounded with a rounded lip 5*a* extending from the top of the trough. The shape of the trough, however, is not crucial. All that is required is that it be placed lower than the plane of elevated surface 3 so that excess liquid will readily accumulate in the trough. The bottom 5*b* of the trough serves as the support for base unit 1. As shown in FIG. 1, at one corner of the trough is located a pour spout 6 to facilitate the disposal of the liquid from the trough.

The base unit may be manufactured using an injection molding technique. However, the base unit may be manufactured at reduced costs with satisfactory results using vacu-forming or thermal forming process. Injection molds are generally more expensive than molds made for vacu-forming or thermal forming processes.

As shown in FIG. 1, frame sections 2*a* and 2*b* each contain two alignment pins 7 and two holes 8 for accepting the alignment pins of the other frame section. The alignment pins and holes ensure that the frame sections are properly and precisely aligned. The frame may contain other means for aligning the two frame sections of the frame assembly together, such as clips that are permanently affixed to two or more sides of the frame.

Each frame section also contains at least two support members 9 which, when the frame sections are combined to form the frame assembly, form a support surface that allows the frame assembly to be placed vertically upright on a horizontal surface. It is not critical tat the support members be located on each frame section. For example, the support members may be placed entirely on one frame section. In the embodiment shown in FIG. 2*b* each frame section contains one-half of a support member depicted as elements 9.

As shown in FIG. 1, the frame assembly is held together by fastening four removable clips 10 along each side of the frame. In place of clips, any suitable means may be used to hold two frame sections together, including screws, stationary clips or lips molded into the frame itself, or plastic or paper tape.

Figure 2B:
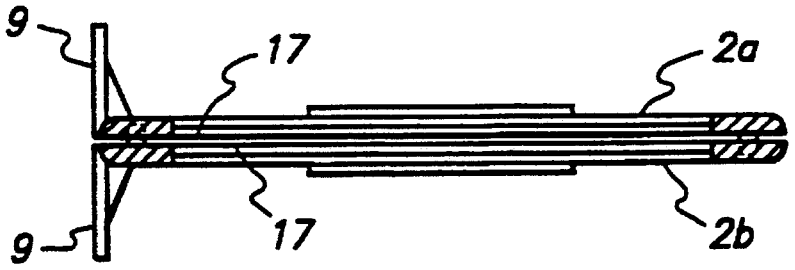
FIG. 2*b* is a cross-sectional view of the frame assembly.
Figure 5:
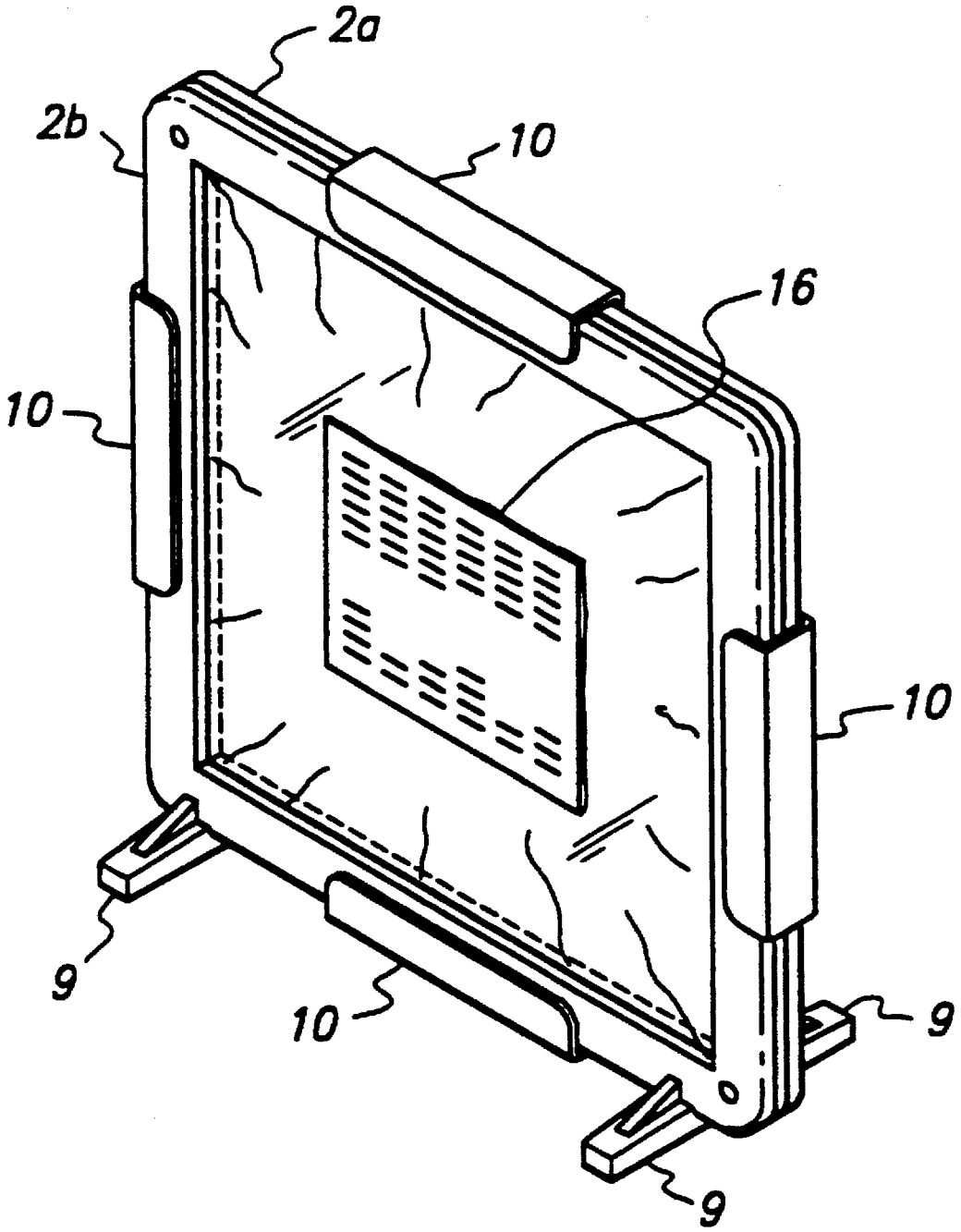
FIG. 5 is a perspective view of the frame assembly as it exists in assembled form with the gel securely held in place between two pieces of film secured by the frame assembly.

As further shown in FIG. 2*b*, the first frame section 2*a* and the second frame section 2*b* of the frame assembly when combined form a smooth seal that firmly holds two pieces of a gel support medium in place. As shown in FIG. 5, the gel support medium as supported by the frame allows for the gel 16 to be held firmly in place toward the center of the frame during the drying process. The gel support medium may be a cellophane film (extruded cellulose xanthate) such as DryEase Mini Cellophane film (manufactured by Novex of San Diego, Calif.). Cellophane is a particularly suitable gel support medium for the purposes of the present invention in that cellophane, when wet, is hydrophilic and readily allows for the vaporization of fluids from the gels. In place of cellophane, other suitable support films include hydrophilic membranes such as hydrophilic cellulose dialysis membranes or hydrophilic nylon membranes.

The frame may be made from a variety of plastic materials including acrylic which is commonly used in the frames of prior art drying devices. The more preferred material for use in applicants' invention is polycarbonate. Polycarbonate is more durable than acrylic and is more resistent to solvents commonly used in drying gels.

In a preferred embodiment, the frame sections of applicants' invention have a common design. In other words, the frame assembly is made up of two identical, interlocking frame members. This is made possible by the fact that, as shown in FIG. 1, the alignment pins 7 are at two corners of the frame, and the alignment holes 8 are at opposite corners. This feature of applicants' invention results in addition cost savings in that only a single cavity mold need be manufactured in order to manufacture the two identical frame sections that, when combined, form the completed frame.

Figure 3:
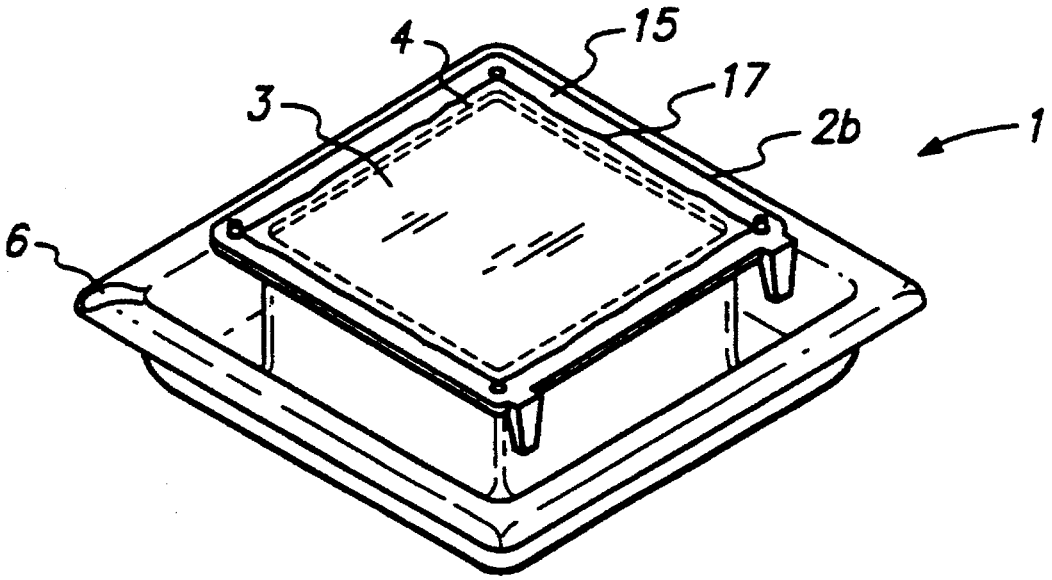
FIG. 3 is a perspective view of one frame section of the frame assembly and base unit combination.
Figure 4:
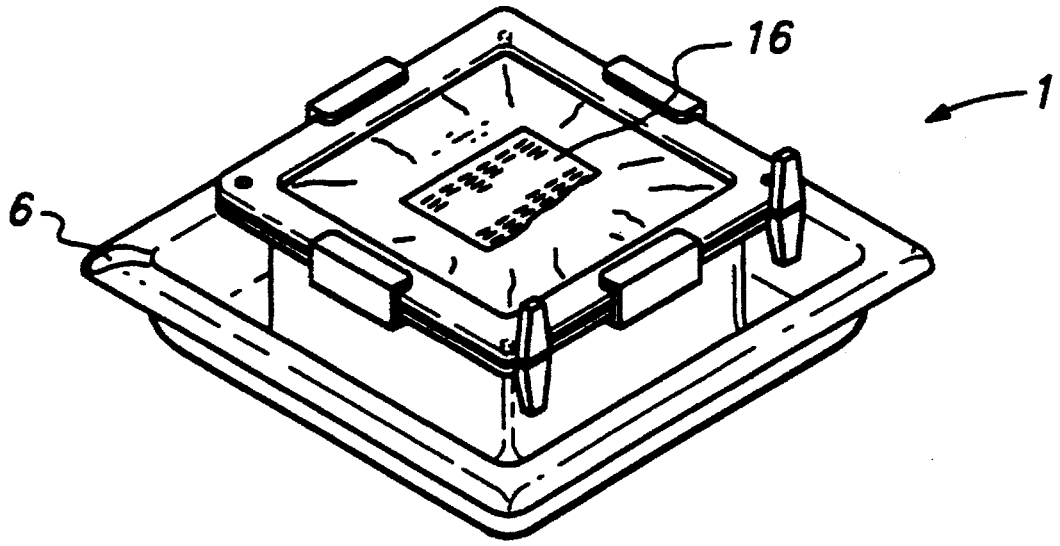
FIG. 4 is a perspective view of the entire frame assembly in combination with the base unit.

FIGS. 3 and 4 show two intermediate steps during the method for drying the gels. In general, the drying procedure is initiated by washing the destained gel in deionized water, preferably on a rotary shaker to accomplish more thorough washing. The gel is then prepared using a drying pre-treatment solution that facilitates the drying process, such as Gel-Dry™ solution (manufactured by Novex of San Diego, Calif.). Another suitable pre-treatment solution is a solution that consists of 5% glycerol, 30% ethanol and the remainder of water (by volume). Other suitable pre-treatment solutions include solutions that consist of up to 40% of a constituent selected from the group consisting of methanol, ethanol or isopropanol and 2% to 10% of glycerol. The glycerol in those solutions serves as a suitable emollient that helps to prevent the gel from becoming brittle as it dries. Another pre-treatment solution that is suitable for low percentage polyacrylamide gels is a 7% to 10% aqueous solution of acetic acid with or without glycerol.

The film is also immersed for a period in the pre-treatment solution. The period of immersion should be long enough (e.g., 15–20 seconds) to ensure complete wetting.

Following the preparation of the gel and the film, as shown in FIG. 3, one section 2*b* of the frame assembly 2 is placed on the flat surface 3 of the base unit 1, secured by the stabilizing indentation 4. When placed on the base, the flat surface 15 of the frame section that accepts the film should be in the same plane as the flat surface 3 of the base unit 1. The film is then centered on the frame/base unit combination such that the first layer of film (item 11 in FIG. 1) lays over the inner edge 17 of the frame.

As shown in FIG. 4, the gel 16 is then placed at the center of the film. To ensure that the drying is accomplished in a uniform fashion, care should be taken to remove all air pockets that may arise between the gel and the film. It is desirable to apply a small amount of pre-treatment solution to ensure that air bubbles do not arise between the gel and the film.

In addition, prior to placing the gel at the center of the film, the gel may require further preparation in the form of cutting off any rough surrounding edges using a gel knife or a razor blade. This procedure should be accomplished with care to ensure that small tears are not created. Such tears may serve as the starting point for crack formation during the drying process.

After the gel is placed at the center of the film, the second layer of film (item 12 in FIG. 1) is added on top of the gel. Care should be taken to ensure that no air pockets are created between the gel and the second layer of film. Any wrinkles that occur during the assembly should be removed, such as by gently rolling a glass pipette slowly across the surface of the assembly. However, it is important that the film not be tightly stretched during the frame assembly process. Stretching of the film may result in the cracking of the gel during the drying process.

The cellophane binds to and supports the gel during the drying process, keeping it flat and dimensionally stable. The cellophane used may be precut, such as DryEase Mini Cellophane film, manufactured by Novex of San Diego, Calif.

As shown in FIG. 1, the second frame section 2*a* of the frame assembly 2 is then added to the first frame section of the assembly. The frame sections are aligned by fitting corner pins 7 of each section into holes 8 on the other section. After the two frame sections of the frame assembly are combined, the clips 10 are clamped onto the four edges of the frame. The completely assembled frame may then be lifted off the base unit.

As shown in FIG. 5, the frame assembly is then stood vertically upright to facilitate the drying process. When the frame assembly is placed upright, the gel 16 remains securely fixed between two film sheets. The drying process in ambient air then occurs.

The unique configuration of the frame assembly allows vaporization to occur from both sides of the gel, which greatly reduces the occurrence of cracks or other distortion during the drying process. The duration of the drying process typically takes between 12 and 48 hours depending upon ambient humidity and the thickness of the gel.

Thus, methods and apparatus for drying electrophoresis gels have been described. One skilled in the art will appreciate that the present invention can be practiced by other than the described embodiments, which are presented for purposes of illustration and not of limitation, and the present invention is limited only by the claims which follow.

We claim:

1. An apparatus for drying electrophoresis gels comprising:

a frame assembly adapted to secure two substantially planar porous hydrophilic gel support surfaces in substantially parallel relation, the frame assembly comprising upper and lower frame sections having opposing surfaces that secure the gel support surfaces within the frame assembly; and a base unit having an elevated surface which receives said lower frame section and holds it in place such that the electrophoresis gel and the gel support surfaces may be disposed in substantially horizontal positions during pre-drying preparation of the frame assembly;

wherein said base unit comprises a trough adapted to accumulate excess liquids during pre-drying preparation of the frame assembly.

2. The apparatus of claim 1, wherein the frame assembly comprises clips that attach to the first and second frame sections on a plurality of sides.

3. The apparatus of claim 1, wherein said base unit comprises a pour spout.

4. The apparatus of claim 1, wherein the elevated surface of the base unit has an indentation adapted to receive the lower frame section such that an upper surface of the lower frame section is substantially co-planar with the elevated surface of the base unit.

5. An apparatus for drying electrophoresis gels comprising a drying frame assembly and a base unit;

wherein said drying frame assembly is adapted to secure two porous gel support sheets in substantially parallel relation;

wherein said base unit comprises an elevated surface surrounded by a trough;

wherein said elevated surface is adapted to support said drying frame assembly horizontal during preparation of said drying frame assembly; and wherein said trough is adapted to catch run-off liquid from said drying frame assembly.

6. The apparatus of claim 5 wherein said drying frame assembly comprises a lower frame and an upper frame and wherein said elevated surface comprises a sheet support surface and a stabilizing indentation;

wherein said stabilizing indentation is located at the periphery of said sheet support surface and is adapted to support said lower frame during preparation of the drying frame assembly;

wherein said stabilizing indentation is adapted to support a lower surface of said lower frame such that an upper surface of said lower frame is substantially co-planar with said sheet support surface; and wherein said sheet support surface in combination with said upper surface of said lower frame is adapted to support one of said two porous gel support sheets during preparation of the drying frame assembly.

7. The apparatus of claim 6 wherein said drying frame assembly comprises a plurality of clips adapted to secure said lower frame to said upper frame.

* * * * *

UNITED STATES PATENT AND TRADEMARK OFFICE

CERTIFICATE OF CORRECTION

PATENT NO. : 5,572,802

DATED : November 12, 1996

INVENTOR(S) : William F. Alpenfels, et al.

It is certified that error appears in the above-indentified patent and that said Letters Patent is hereby corrected as shown below:

Cover page, in the ABSTRACT, replace "The base unit serves as a both" with -- The base unit serves as both --.

Col. 4, line 46, change "trough S" to -- trough 5 --.

Col. 5, line 9, change "tat" to -- that --.

Signed and Sealed this

Twenty-third Day of February, 1999

*Attest:*

Q. TODD DICKINSON

*Attesting Officer*

*Acting Commissioner of Patents and Trademarks*